United States Patent [19]

Ricouard et al.

[11] Patent Number: 4,637,507

[45] Date of Patent: Jan. 20, 1987

[54] COIN LOCK DEVICE FOR SHOPPING TROLLEYS

[75] Inventors: Jacques Ricouard, Sancoins; Claude Chappoux, Mornant; both of France

[73] Assignee: Ronis S.A., Lyons, France

[21] Appl. No.: 716,867

[22] Filed: Mar. 27, 1985

[51] Int. Cl.[4] ..... G07F 17/10

[52] U.S. Cl. ..... 194/212; 194/247; 194/905; 70/DIG. 41

[58] Field of Search ..... 194/1 E, 4 B, 4 D, 4 R, 194/54, 67, 4 G, 55, 2, 4 E, 4 F, 93, 64, 1 R, 4 C, 205, 212, 247, 905; 70/DIG. 41; 221/199

[56] References Cited

U.S. PATENT DOCUMENTS

| | | | |
|---|---|---|---|
| 1,498,047 | 6/1924 | Ledin | 70/DIG. 40 X |
| 3,165,189 | 1/1965 | Easterday | 194/4 F |
| 3,197,008 | 7/1965 | Moore | 194/64 |
| 3,338,364 | 8/1967 | Hoffberger II, et al. | 194/4 R |
| 3,519,114 | 7/1970 | Waller et al. | 194/54 |
| 4,474,280 | 10/1984 | Lenander | 194/1 E X |
| 4,474,282 | 10/1984 | Lenander | 194/1 E |
| 4,573,564 | 3/1986 | Rheeder et al. | 194/905 X |
| 4,589,538 | 5/1986 | Payraudeau | 194/205 |

FOREIGN PATENT DOCUMENTS

| | | | |
|---|---|---|---|
| 0070997 | 2/1983 | European Pat. Off. | 194/4 D |
| 2725530 | 12/1978 | Fed. Rep. of Germany | 194/1 R |
| 2900367 | 7/1979 | Fed. Rep. of Germany | 194/4 R |
| 2445423 | 7/1980 | France . | |
| 8201950 | 6/1982 | World Int. Prop. O. | 194/54 |
| 8404835 | 12/1984 | World Int. Prop. O. | 194/905 |

*Primary Examiner*—Joseph J. Rolla
*Assistant Examiner*—Edward S. Ammeen
*Attorney, Agent, or Firm*—Dowell & Dowell

[57] ABSTRACT

The invention relates to a coin lock device having a housing, a protruding element extending from said housing and an aperture in the housing for the reception of a protruding element of an identical lock device.

A key element is secured to one end of a slide piece which slides against the action of a spring, which slide piece is connected at the other end with a cylinder core having movable, transversely disposed tumblers. The cylinder core slides in an aperture in the housing and is movable under the action of the return spring of the slide piece to a rest position. In the rest position the tumblers engage apertures formed in the surface of the aperture receiving the cylinder core, out of which they can be pushed by the introduction of a key element of a second identical device into the cylinder core.

An ejector movable against a spring is provided in the housing to effect release of the cylinder core and hence disengagement of locking device between the device and an adjacent identical device on insertion of a coin. The ejector also serves to release the coin on introduction of a key element of another device into the cylinder core.

11 Claims, 10 Drawing Figures

COIN LOCK DEVICE FOR SHOPPING TROLLEYS

BACKGROUND TO THE INVENTION

The invention relates to a coin lock device having a housing and a protruding (male) element, having an aperture for the reception of the element of an identical lock device, locking devices in the aperture which are actuated by a device for the insertion of a coin and devices for the release of the coin on introduction of a protruding element into the aperture.

Such devices are known for locking shopping trolleys used in stores or public institutions and to remind the user to put his trolley back into a row after use. These known devices, whether they are purely mechanical or electro-mechanical, are expensive in construction, of large size, insufficiently reliable, and heavy.

OBJECT OF THE INVENTION

It is an object of the invention to produce a coin lock device which renders locking possible only on an identical device which in turn has already been locked on an identical apparatus or on a carrier identical with such devices. A further object is the provision of a coin lock device affording security of locking but which can be unlocked by simple insertion of a coin of specific diameter. The dimensions and weight of the device may be reduced by comparison with known mechanisms.

SUMMARY OF THE INVENTION

According to the invention there is provided a coin lock device comprising (a) a housing formed with an aperture for the reception of a protruding element of an identical coin lock device, (b) a protruding element extending from said housing serving to engage an aperture of an identical coin lock device, (c) a locking mechanism within said housing having a locking member extending into the aperture of said lock device effecting locking together of said coin lock device and an identical coin lock device when said aperture is in reception of the protruding element of the identical coin lock device, (d) a coin operated mechanism for releasing said locking mechanism on insertion of an appropriate coin, (e) means for releasing said coin on introduction of a protruding key element of an identical coin lock device, (f) an elongated slide piece within said housing, (g) a key element profiled with raised and recessed portions, secured to said slide piece at one end thereof and extending into the aperture in said housing from within the latter, (h) a spring urging said slide piece in one direction, (i) a cylinder core slidably movable within a bore in said housing and secured to the other end of said slide piece, and (j) tumblers disposed transversely of the longitudinal axis of the bore and engageable in a rest position of the core with apertures formed in the wall of the bore, said tumblers being capable of being pushed out of engagement with said apertures by the introduction of a protruding key element of an identical coin lock device into the cylinder core, whereupon said core is movable against the influence of said spring to effect release of said locking mechanism.

The device is simple, compact, secure, durable, economical and may be of light weight. The possibility of one device being connected to a second if the second is not already connected to a third or to a docking station is prevented with simple means. Constructionally simple parts, especially ordinary lock cylinders or ordinary cylinder cores, can be utilised.

The device may easily be adapted to coins of different diameters and troubles can be eliminated simply. It is also possible to make the device so that the sensing levers exert no direct effect upon the locking of the bar, which permits their easy exchange for adaptation to different coin sizes. Moreover a locking bar arranged in addition to the slide piece is not absolutely necessary, which considerably simplifies the device.

BRIEF DESCRIPTION OF DRAWINGS

An example of embodiment will be described hereinafter and is represented in the drawings, wherein.

DESCRIPTION OF PREFERRED EMBODIMENTS

Figure 3:
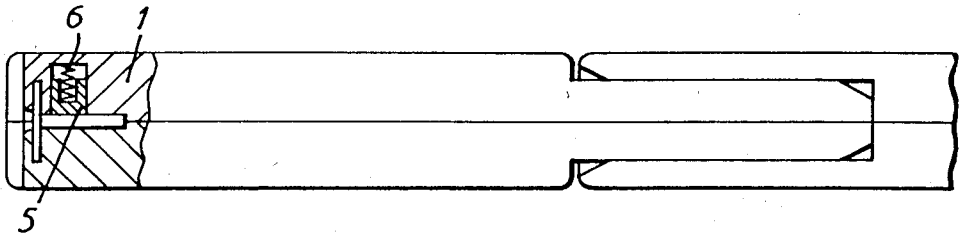
FIG. 3 shows a plan view of a part of the device according to FIGS. 1 and 2, in partial section.

A coin lock device comprises a carrier housing 1 having an admission plate 2 for a coin 18, secured in front of a coin reception chamber. An elongated horizontal ejector 3, loaded in the coin ejection direction by a spring 4, extends into the chamber from a direction remote from the plate 2. Between the plate 2 and the ejector 3 there is provided a lateral brake 5 for the coin displaceable by a spring 6 (FIG. 3). The two-armed rocker levers 7 and 8, urged by the springs 9 and 10, terminate adjacent the plate 2 and have guide rollers 11 and 12 on both sides and pivot on spindles 13 respectively. The free ends of ejector 3, levers 7, 8 and brake 5 extend into the chamber.

The housing 1 has beneath the plate 2 and the chamber an aperture 1*a* into which an actuating pawl 14 extends from above, which pawl is loaded towards the aperture 1*a* by a spring 15. The levers 7 and 8 are articulatedly connected respectively to locking sliders 16 and 17, on the ends thereof remote from the chamber.

The end 19 of the ejector 3 remote from the plate 2 is provided with a notch for receiving a locking slider 20 which is loaded towards the ejector 3 by a spring 21. A catch action is completed by insertion of the coin 18 which pushes in the ejector 3 against the action of its spring 4. With no coin present the locking sliders 16 and 17 effect locking of a locking bar 22 subject to the action of a spring 23 by means of the co-operation of the edge of a slot in the slider 16 with a rectangular recess 24 formed in the bar 22 and the blocking of the bar 22 by the slider 17 being in a blocking position in front of the bar 22.

A further spring-loaded locking slider 25 co-operates with a further rectangular recess formed in the bar 22 and is shifted against the action of its spring by an oblique face of ramp form on the ejector 3. Movement of the ejector 3 without pivoting of the rocker lever 7 is prevented by engagement of a nose 26 with the locking slider 16.

The ejector is formed at the end adjacent the plate 2 with an opening 27, so that the insertion of too small a coin, followed by another coin, does not permit movement of the ejector. These measures are provided to avoid undesired jamming. Moreover an implement inserted into the opening of the ejector 3 meets a fixed part 28 of the housing.

Figure 1:
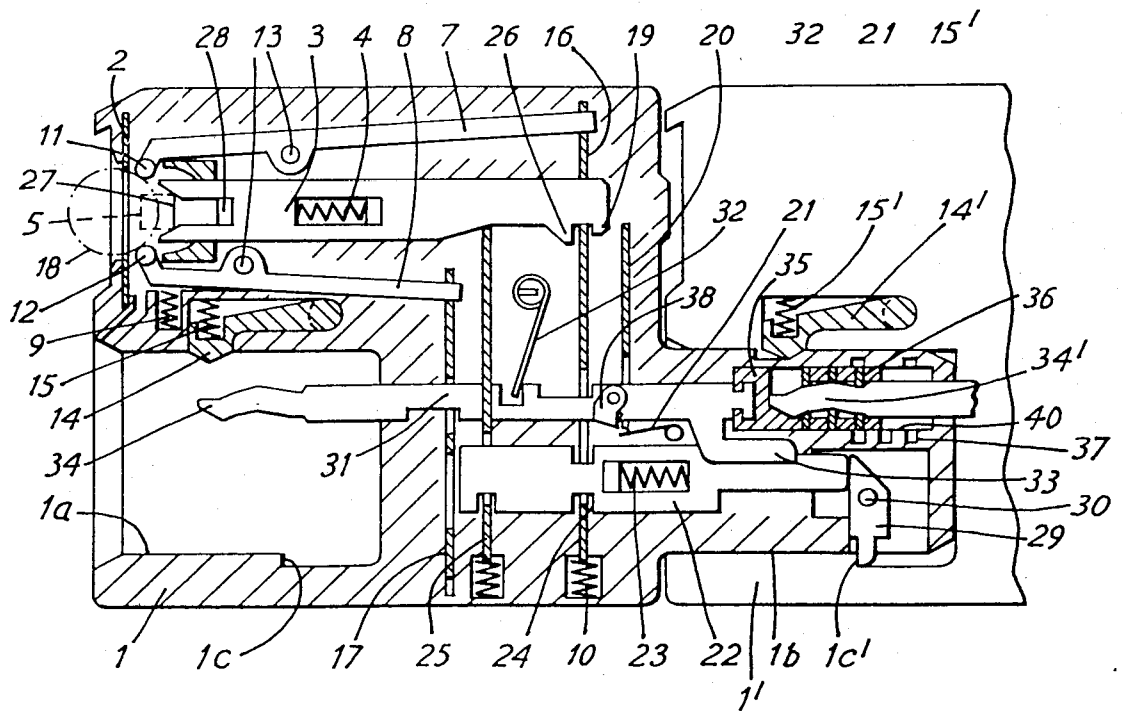
FIG. 1 shows a longitudinal section through a first example of embodiment of a coin lock device which is attached and locked to an identical device.
Figure 2:
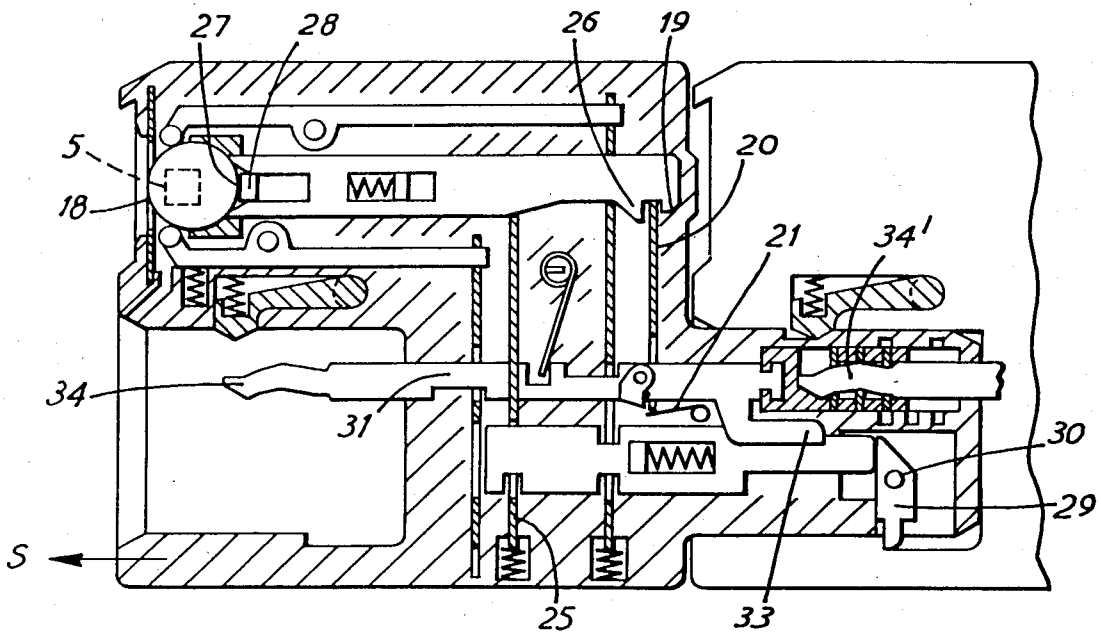
FIG. 2 shows an identical coin lock device which has been unlocked by insertion of a coin.

The rearward part of the housing forms a projection **1*b* formed with a recess in which there is provided a so-called reversing lever 29 which is pivotally mounted on a pin 30; one end of the lever co-operates with the end of the bar 22. An elongated horizontal slide piece 31 is loaded in the longitudinal direction by a spring 32 and is formed by a terminal step piece 33 which extends in said longitudinal direction but offset from the longitudinal axis of said elongated slide piece 31. Introduction of a coin 18 (FIG. 2) effects a release of the locking bar 22 and a pull of the device in the direction S effects a rotation of the reversing lever 29 to such extent that the end of the reversing lever 29 opposite to the bar 22 strikes against a step 1*c*' of the aperture 1*a* of an identical device hitherto locked to the device. At the same time the piece 31 slides back under the action of its spring 32 (FIG. 4) and the step piece 33 blocks the lever 29** in the unlocked position.

Figure 4:
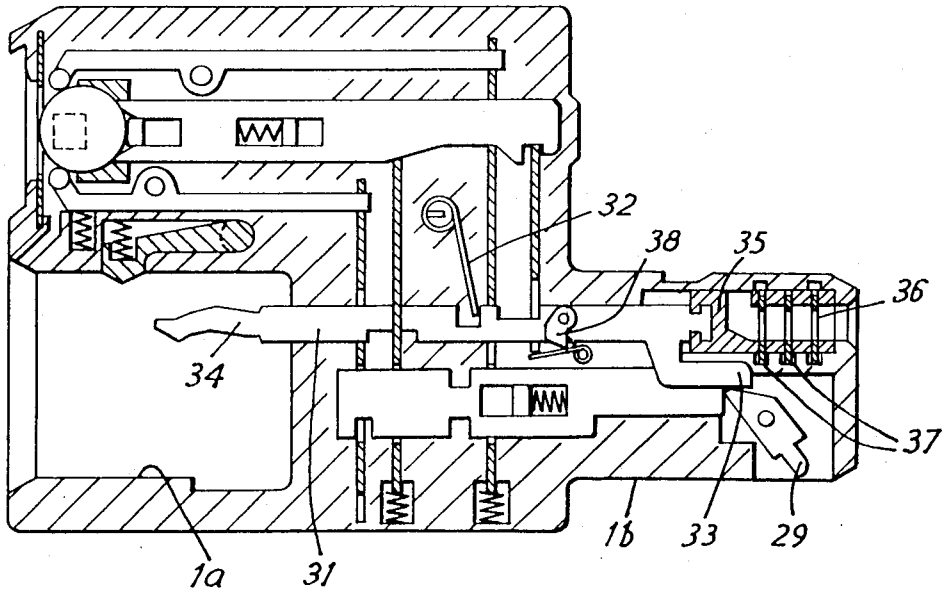
FIG. 4 shows a longitudinal section through a device not attached to an identical device.

The slide piece 31 terminates at the end remote from the lever 29 in a male profiled element 34 of function and nature of a key shank, especially of a flat key element. The slide piece 31 carries at the end remote from the element 34, beside the step piece 33, a cylindrical slide element 35 of the style and function of an axially movable cylinder core of a lock cylinder, in which plate tumblers 36 slide transversely of the axis. The longitudinal axis of the slide element 35, arranged at right angles to the tumbler plates 36, in the direction of which axis the slide element 35 is shifted along by the slide piece, is coaxial with the longitudinal axis of the longitudinally displaceable slide piece 31. The slide element 35 is displaceable in a cylindrical bore 40 formed with upper and lower apertures 37 to receive the tumblers. If the device is situated in the position as shown in FIG. 4, each of the tumblers 36 stands opposite to an aperture 37 and engages in it due to gravity, so that the slide element 35 is locked in its position and the slide piece 31 is immovable.

Insertion of the male profiled element or key 34' of an identical device into the longitudinal key passage of the slide element 35 effects raising of the tumblers 36 and unlocking of the slide element 35. The slide piece 31 is pushed to the left against the action of the spring 32 and the abutment of the element 34' effects a displacement of the element 35 and of the slide piece 31. During this action a pawl 38 on the slide piece 31 displaces the locking slider 20 which releases the ejector 3, and the step piece 33 of the slide piece 31 releases the reversing lever 29.

Thrust by the locking bar 22 under the action of its spring 23, the lever 29 assumes its locked position (FIG. 2) as soon as the device enters the preceding one. The device is thus then connected by the pawl 14' and its spring 15' to the preceding device, so that a pressure upon the reversing lever 29 is avoided during the insertion of the coin. When the bar 22 has likewise resumed its locking position, the locking sliders 16 and 17 are released and the coin 18, pushed by the ejector 3, the spring of which is stronger than the return springs of the sliders 16, 17, is pushed out through the plate 2, but is held fast by the brake 5, pressed by the spring 6.

The design has the effect that attachment and locking are possible only to an identical device which in turn is already locked to a third device or to an end carrier which works in a similar manner to such a device. If one seeks to connect the device to a second device which is not in turn connected to a third identical device, the slide piece 31 of the second device is situated in the position as shown in FIG. 4, and the introduction of the element 34' of the first device into the slide element 35 does not permit displacement of the slide piece 31, which is locked by the catch 20.

The device according to the invention is very flat and accordingly forms only a narrow projection. If it is fitted for example on to a vehicle, especially a shopping trolley, this can be situated laterally or on top.

It can be provided that with the aid of a key (not shown) introduced into the housing 1, the sliders 16, 17 and the catch 25 can be aligned again in order to release the bar 22 and the reversing lever 29 in the case of an abnormal blocking of the system.

Likewise an element (not shown) can be provided to uncouple the reversing lever 29 from the bar 22, in order to release a defective device for repair.

The second example of embodiment, shown in FIGS. 5 to 10, will be described below. The two rocker levers 7 and 8 are retracted on both sides by springs 9 and 10 and terminate adjacent the plate 2 with feelers 11 and 12 having ends which extend towards each other.

The end 19 of the ejector 3 near to the plate 2 again has a locking slider 20, urged by a spring 21. The locking action is effected by the insertion of the coin 18 (see FIG. 6), which pushes the expulsion device 3 against the action of its spring 4.

In the absence of the coin 18 (FIG. 5) the locking slider 20 engages a rectangular recess 50 of the slide piece 31 which is loaded by a spring 32. The slider 20 blocks the slide piece 31. The slide piece 31 again extends into the aperture **1*a* of the housing 1 by way of a profiled male element 34 having the function of a key, which is dependent upon displacement of the slide piece 31**.

At its opposite end the slide piece 31 is connected with a slide element 35 having the function of a lock cylinder or cylinder core in which tumblers 36 slide transversely. The slide element 35 is mounted in a bore 40 having recesses 37 to receive the tumblers. When the device is released, as in the position according to FIG. 7, after the insertion of the coin, each of the tumblers 36 stands opposite to a recess 37 and snaps in there due to the force of gravity, so that the slide element 35 locks in its mounting and the slide piece 31 is immovable.

Figure 5:
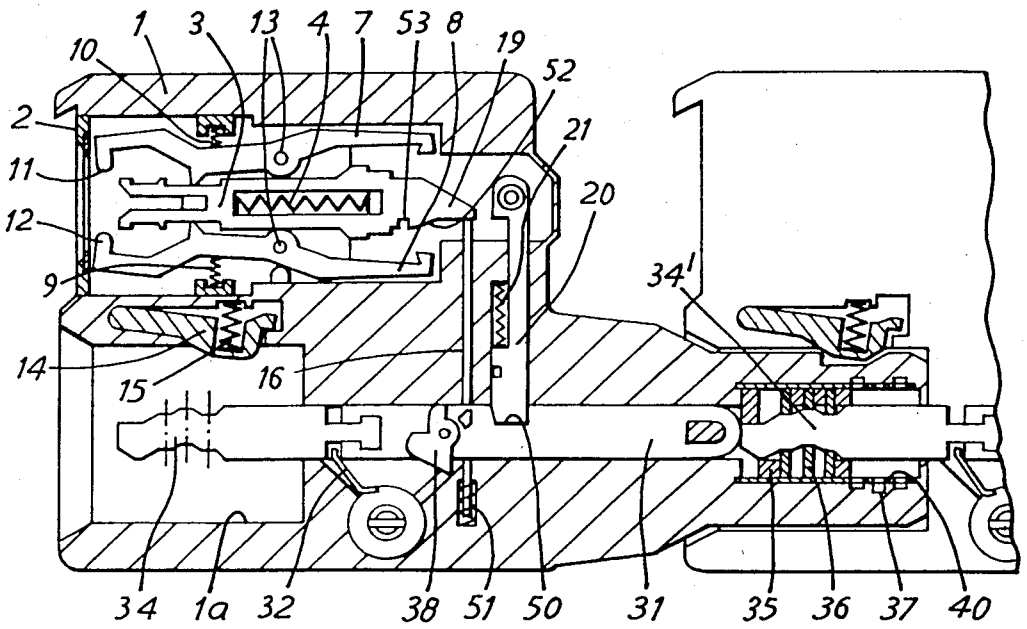
FIG. 5 shows a diagrammatic longitudinal sectional view of a second example of embodiment of a device locked to an identical device.

The device also comprises a locking slider 16 subject to the action of a spring 51, which exerts pressure upon the end 19 of the ejector 3 in the locking position (FIG. 5). During the insertion of the coin 18 a bevel 52 of the ejector 3 pushes the slider 16 back against the action of the spring 51, and at the end of this action the slider 16 engages resiliently in a rectangular recess 53 formed in the ejector 3, which thus is locked against the action of its spring 4 (FIG. 6).

The introduction of the male element or key 34' of an identical device into the lock cylinder 35 of a device effects the renewed raising of the tumblers 36 and the unlocking of the sliding element/cylinder core 35. As seen in FIG. 6 the slide piece 31 is pushed to the left with the lock cylinder 35, pushed by the key or element 34. During this action a pawl 38 on the slide piece 31 shifts the slider 16 downwards, against the action of the spring 51, which releases the ejector 3, which under the action of its spring 4 presses the coin 18 outwards, which parts the feelers 11 and 12 and causes rotation of the rocker levers 7 and 8. The coin 18 is expelled, and the device is in the locking condition as in FIG. 5.

Figure 6:
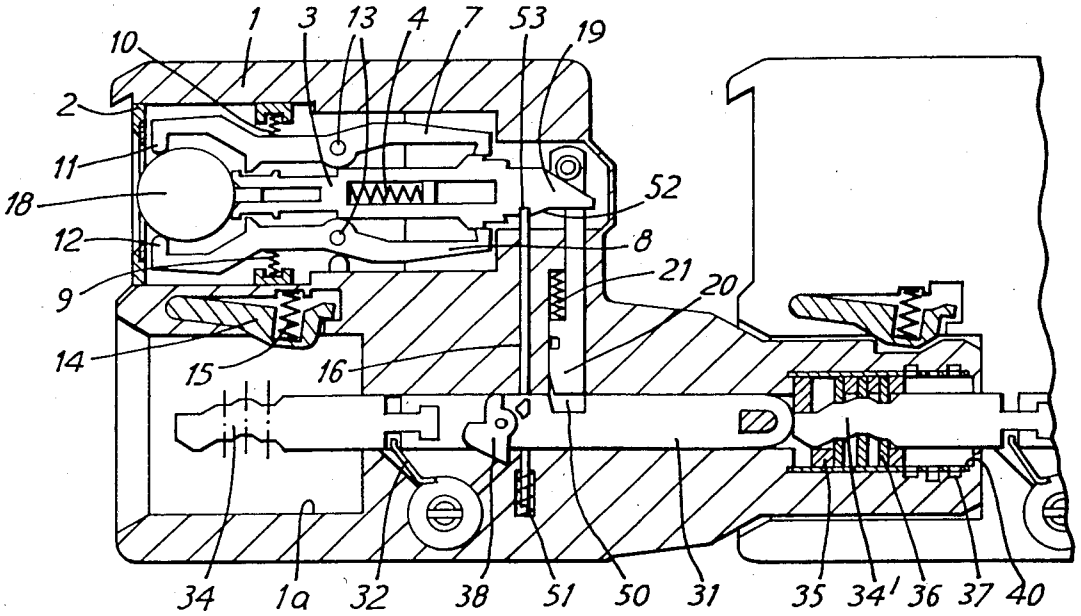
FIG. 6 shows a section according to FIG. 5 while the device is being unlocked by insertion of a coin.

Insertion of a coin 18 unlocks the locking slider 20 and the device can be disengaged as desired from an identical device or a carrier with male element 34' to which it was attached (FIG. 6).

Figure 7:
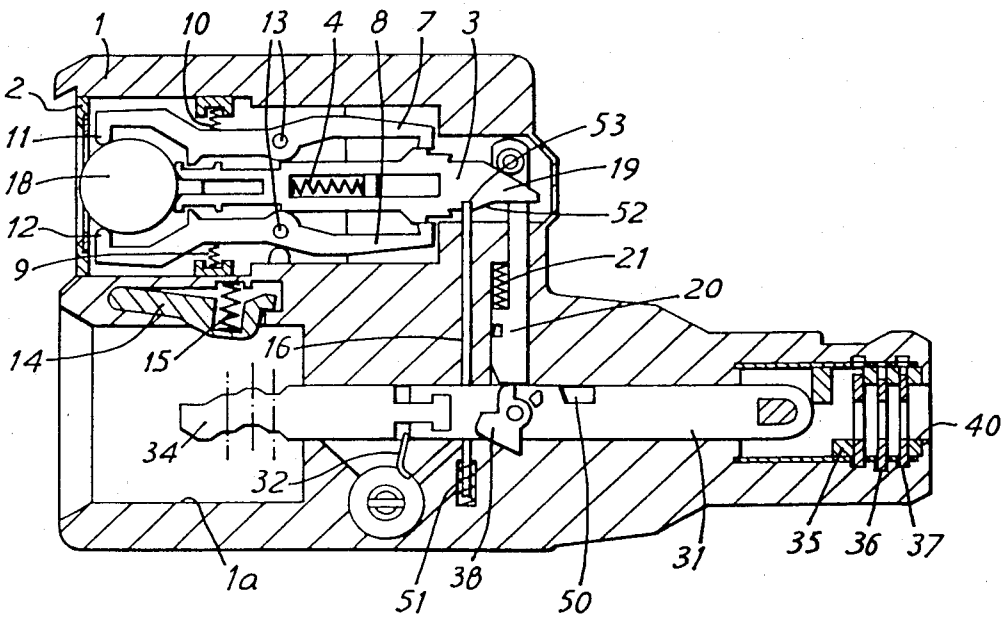
FIG. 7 shows the device according to FIGS. 5 and 6 released from another identical device.
Figure 8:
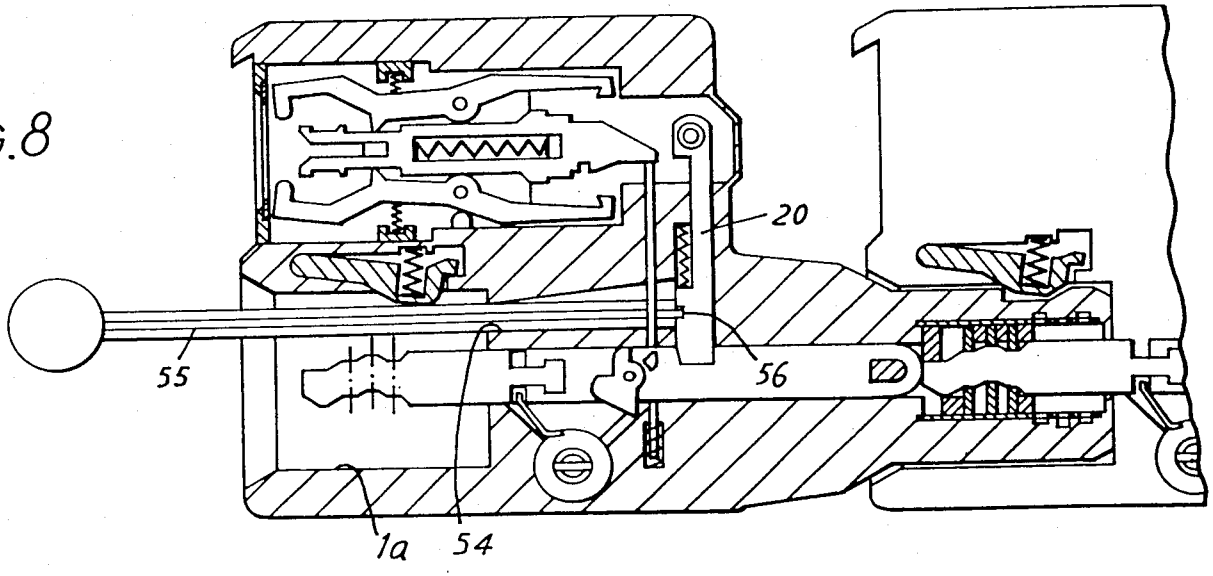
FIG. 8 shows the device according to FIGS. 5 to 7 during fault elimination and blocked on an identical device.
Figure 9:
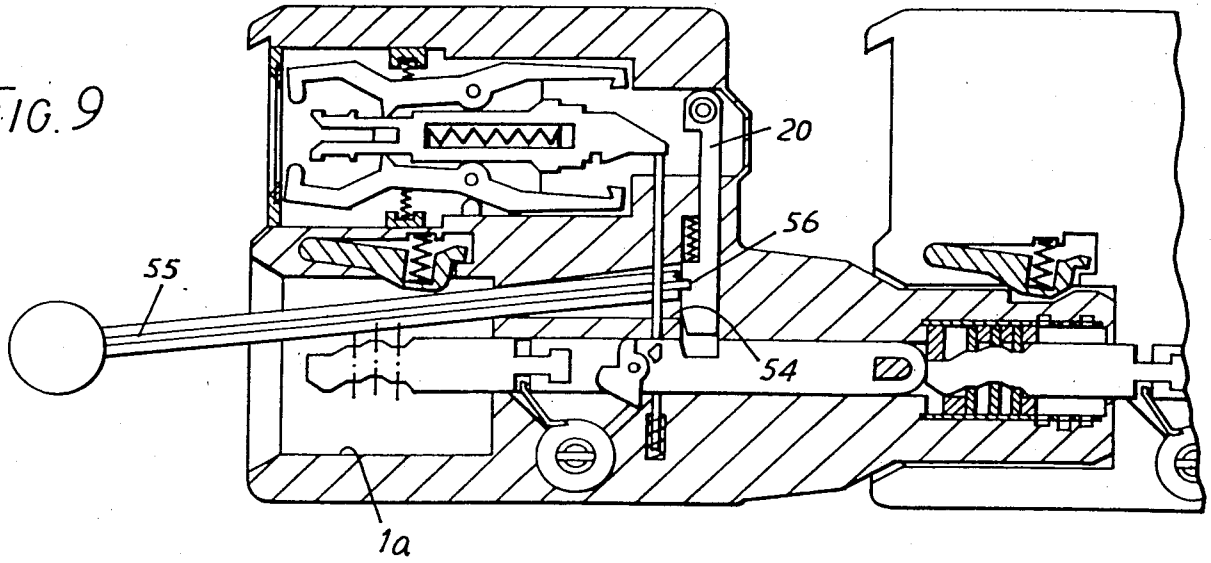
FIG. 9 shows a section according to FIG. 8 at the end of the fault elimination.
Figure 10:
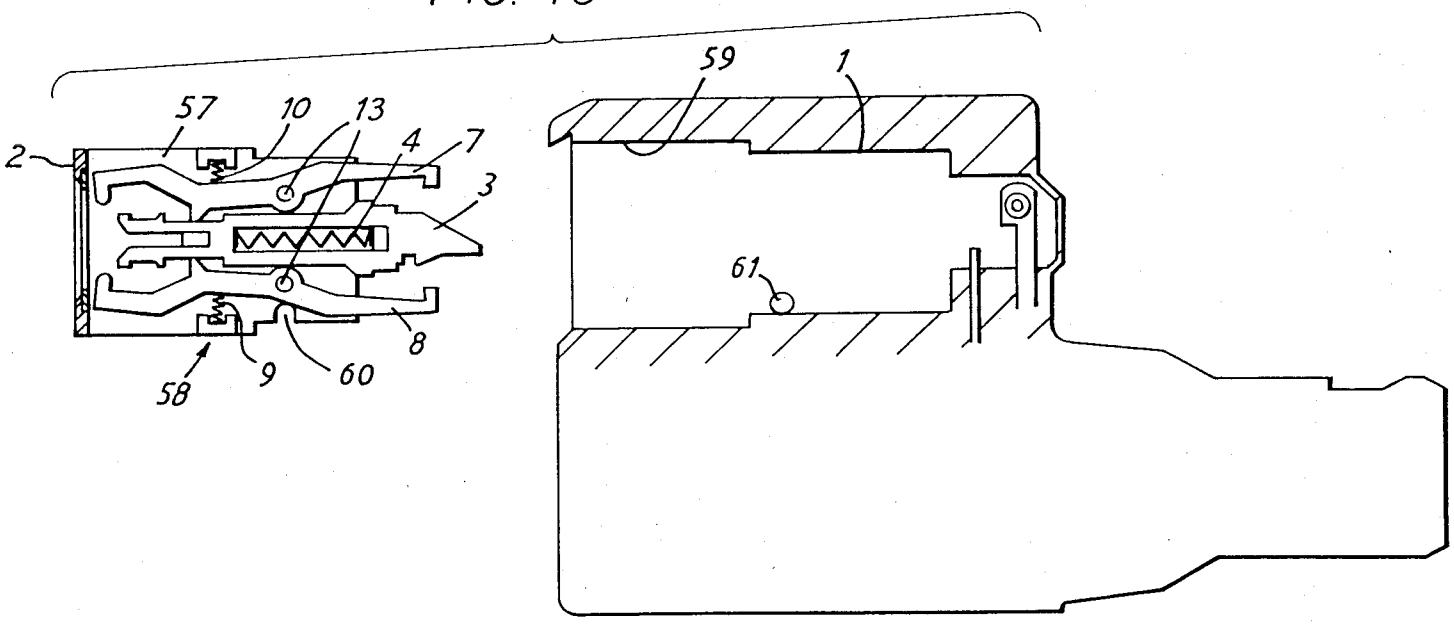
FIG. 10 shows a diagrammatic longitudinal sectional view of the device according to FIGS. 5 to 9 in the course of a modification for adaptation to a coin diameter.

In the locking position as shown in FIG. 7 it is impossible to introduce the key or the element 34 of a device completely in the same locking position because the element 34' does not reach far enough into the aperture 1*a'* to penetrate fully into the lock cylinder or cylinder core. Thus the formation of disorderly lines is prevented.

In the case of blockage of the device during which no coin can be introduced, a passage 54 in the aperture 1*a* permits the insertion of a profiled key 55 (FIG. 8), the end of which penetrates into an aperture of the locking slider 20. Tilting of this key 55 (FIG. 9) lifts the locking slider 20 and permits separation of the device for the purpose of repair.

According to a further important embodiment of the invention (illustrated in FIG. 10), the rocker levers 7 and 8 with their springs 9 and 10 are pivotally mounted by pins 13 on an independent carrier 57 which carries the inlet plate 2, the ejector 3 and its spring 4. This assembly 58, which constitutes a replaceable cassette for adaptation to different coin diameters, is mounted loosely in an aperture 59 of the carrier housing 1. The cassette 58 is secured in the aperture 59 by means of a special screw (not shown) which requires a special tool for release. This screw passes through a depression 60 of the carrier 57 and an internal threading of the carrier housing 1. This cassette device, apart from modification of an existing device, permits dismantling for repair, and above all the use of an identical assembly, apart from the cassette, for different coins.

We claim:

1. A coin lock device comprising (a) a housing formed with an aperture for the reception of a protruding element of an identical coin lock device, (b) a protruding element extending from said housing serving to engage an aperture of an identical coin lock device, (c) a locking mechanism within said housing having a locking member extending into the aperture of said lock device effecting locking together of said coin lock device and an identical coin lock device when said aperture of the coin lock device is in reception of the protruding element of the identical coin lock device, (d) a coin operated mechanism for releasing said locking mechanism on insertion of an appropriate coin, (e) means for releasing said coin on introduction of a protruding key element of an identical coin lock device, (f) an elongated slide piece within said housing, (g) a key element profiled with raised and recessed portions, secured to said slide piece at one end thereof and extending from within said housing into the aperture in said housing (h) a spring urging said slide piece in one direction, (i) a cylinder core slidably movable within a bore in said housing and secured to the other end of said slide piece, and (j) tumblers disposed transversely of the longitudinal axis of the bore and engageable with apertures formed in the wall of the bore when said core is in a rest position, said tumblers being capable of being pushed out of engagement with said apertures by the introduction of a protruding key element of an identical coin lock device into the cylinder core, whereupon said core is movable against the influence of said spring to effect release of said locking mechanism.

2. A device according to claim 1, including an ejector slidable within said housing and movable by the insertion of a coin, a second spring between said ejector and said housing, a first locking slider in said housing, a third spring between said locking slider and said housing and a pawl pivotally mounted on the elongated slide piece, said first locking slider being cooperable with a rectangular aperture formed in said elongated slide piece and said pawl being cooperable with said locking slider.

3. A device according to claim 2, including an inlet plate having an aperture for receiving a coin, rocker levers pivotally mounted in the housing, coin engageable rollers mounted on the ends of the rocker levers situated between said plate and the ejector, and second and third locking sliders within said housing operable by said rocker levers, at least one serving to lock said ejector with said second spring in a loaded condition.

4. A device as claimed in claim 3, wherein said locking mechanism includes a locking bar, a fourth spring between said locking bar and said housing, said locking bar being cooperable with said second and third locking sliders and being movable by said fourth spring subsequent to the release thereof by said locking sliders thus in turn releasing the locking member whereby the locking member can disengage a step formed within the aperture of the housing which receives the protruding element of an identical coin lock device.

5. A device according to claim 4, including a step piece on said elongated slide piece, which step piece serves to hold said locking member in its unlocked position when said tumblers are in engagement with their respective apertures.

6. A device according to claim 5, wherein said ejector is capable of actuating said first locking slider for the release of the locking bar.

7. A device according to claim 1, including a pawl extending into the aperture of the housing, and a further spring acting on said pawl, for the connection to another identical device by entry of said pawl into a recess formed on the exterior of the protruding element of an identical lock device.

8. A device according to claim 3, including a spring-loaded brake for holding the released coin disposed adjacent said coin inlet plate.

9. A device according to claim 1, including an ejector slidable within said housing and movable by the insertion of a coin, a second spring between said ejector and said housing, a first locking slider in said housing, a third spring between said first locking slider and said housing, said first locking slider being movable by said ejector as the coin is inserted and being cooperable with a rectangular aperture formed in said elongated slide piece, rocker levers pivotally mounted in the housing serving to restrict the sliding movement of the ejector in the absence of a coin, coin engageable feelers provided on the ends of the rocker levers situated between a coin inlet plate and the ejector, a second locking slider within said housing serving to lock said ejector with said second spring in a loaded condition, a fourth spring between said second locking slider and said housing, and a pawl pivotally mounted on the elongated slide piece being cooperable with said second locking slider.

10. A device according to claim 2, wherein the housing is provided with a passage which leads from the aperture in the housing to the interior thereof and affords entry of a suitably profiled tool to effect release of said first locking slider.

11. A device according to claim 9, including a carrier removably mounted in an aperture in said housing, said carrier having mounted thereon pivot pins on which said rocker levers are pivotally mounted, springs for urging said levers in a manner to move the feelers towards each other, the coin inlet plate, the ejector, said second spring, said carrier forming an exchangeable cassette.

* * * * *